United States Patent [19]

Eberle

[11] 4,345,452

[45] Aug. 24, 1982

[54] CAM SHAFT OPERATED PUNCH PRESS FOR EXPANDING LEAD ALLOY BATTERY GRID MATERIAL

[75] Inventor: William J. Eberle, Reading, Pa.

[73] Assignee: General Battery Corporation, Reading, Pa.

[21] Appl. No.: 66,797

[22] Filed: Aug. 15, 1979

[51] Int. Cl.[3] ..... B21D 28/20

[52] U.S. Cl. ..... 72/452; 29/2; 29/163.5 R; 72/404; 72/419; 74/567; 74/603; 83/260; 83/628

[58] Field of Search ..... 72/452, 419, 324, 325, 72/404; 29/2, 163.5 R; 83/628, 260; 74/603, 567

[56] References Cited

U.S. PATENT DOCUMENTS

| | | | |
|---|---|---|---|
| Re. 19,477 | 2/1935 | Dixon | 29/163.5 R |
| 1,575,239 | 3/1926 | Walker | 74/603 |
| 2,458,160 | 1/1949 | Grappe | 83/628 |
| 2,850,093 | 9/1958 | D'Angelo | 83/628 |
| 3,045,518 | 7/1962 | Kjelgaard | 83/628 |

FOREIGN PATENT DOCUMENTS

| | | | |
|---|---|---|---|
| 2810 | of 1904 | United Kingdom | 83/260 |

*Primary Examiner*—Gene Crosby
*Attorney, Agent, or Firm*—Benasutti Associates, Ltd.

[57] ABSTRACT

A punching apparatus for punching a strip of lead alloy material into a battery grid is provided with a support for supporting the material to be punched thereon and biased punch members above the support for punching through the material. Rotating cams engage the punch members and force the punch members downward through the material on the support. Rollers provided adjacent the support and the material to be punched move the material across the support means synchronously with the motion of the rotating cams engaging the punches.

5 Claims, 2 Drawing Figures

CAM SHAFT OPERATED PUNCH PRESS FOR EXPANDING LEAD ALLOY BATTERY GRID MATERIAL

BACKGROUND OF THE INVENTION

The present invention relates to the art of expanding grids for batteries, and in particular, relates to a cam shaft operated punch press for expanding lead alloy battery grid material.

In the field of expanding battery grid material, it is well known to use either rotary or reciprocating punch presses. Even though rotary punch presses are capable of obtaining greater speeds, the reciprocating punch presses are generally preferred in spite of their relatively lower speed. Generally, a reciprocating punch press comprises a punch platen on which are mounted as many as forty-four dyes which reciprocate with the platen to simultaneously punch and expand forty-four notches in a strip of grid material which is being worked on. At the present time, however, the speed of these processes is limited to approximately 200 strokes per minute. At speeds greater than 200 strokes per minute, the vibration caused by the inertia of the machine becomes so great that higher processing speeds are unattainable.

If it were possible, it would be preferred to expand grid material using machines which were capable of making forty-four slits per stroke at a rate of approximately 600 strokes per minute. The major drawback is that no reciprocating expanded metal punch press is known which is capable of obtaining speeds on this order of magnitude.

SUMMARY OF THE INVENTION

It is an objective of the punch press of the present invention to overcome the disadvantages which are inherent in the presently available reciprocating punch presses for expanding strip grid material. This objective is obtained by providing a plurality of punches, each of which is journeled within a bore in a top plate. The movement of each punch within the bore is in a manner similar to that of a piston within a cylinder, each punch being biased upwardly to cause reciprocating movement thereof.

BRIEF DESCRIPTION OF THE DRAWINGS

Further understanding of the present invention and the objectives acheived thereby is possible from the following detailed detailed description of the invention taken in conjunction with the formal drawing, wherein.

DETAILED DESCRIPTION OF THE INVENTION

Figure 1:
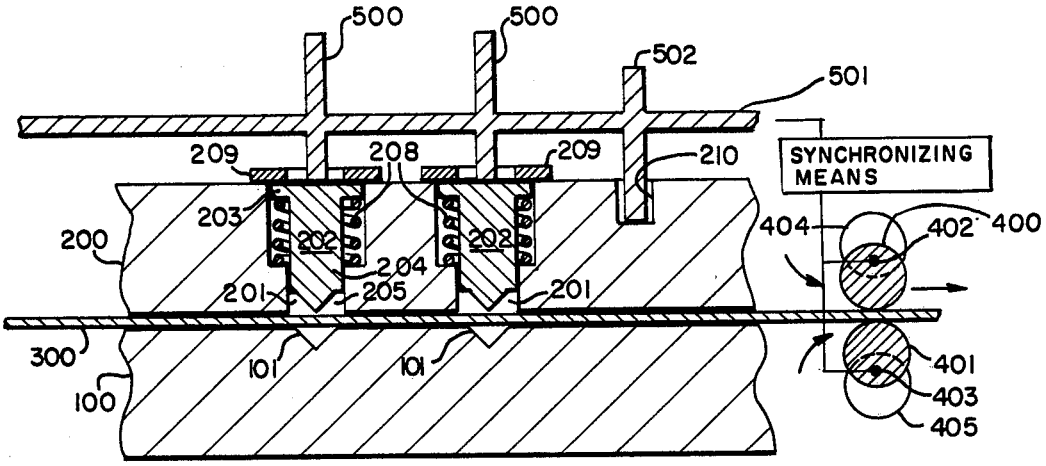
FIG. 1 is a fragmented, cross-sectional view of the apparatus with two punch members in their upper position.

Although specific forms of the invention have been selected for illustration in the drawings, and the following description is drawn in specific terms for the purpose of describing these forms of the invention, this description is not intended to limit the scope of the invention which is defined in the appended claims.

Figure 2:
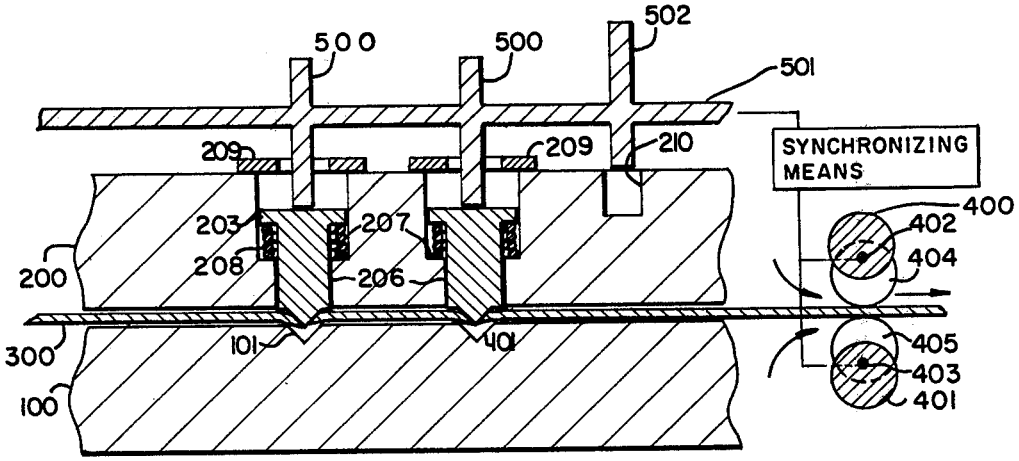
FIG. 2 is a fragmented, cross-sectional embodiment of the present invention with the punch members in their lowered position.

As shown in both FIGS. 1 and 2, the apparatus includes a base plate 100 with a top plate 200 spaced thereabove. A strip 300 of lead or lead alloy travels across the base plate due to the pulling force of two eccentric rollers 400, 401 located above and below one end of the strip. Fitted inside openings 201 in the top plate are punch members 202 which are slidable up and down within these openings. The punch members 202 engage cam members 500 which are eccentrically mounted on a rotatable drive shaft 501. The rotation of the drive shaft 501 causes the cam members to push the punch members 202 downward through the openings until they pierce the lead alloy strip 300 on the base plate 100.

The base plate 100 is a substantially flat and smooth surface. However, there are a plurality of recesses 101 in the base plate which are adapted to receive the punch members 202 as they pass through the alloy strip 300, thus allowing the punch members to completely pass through the strip. The top plate 200, as pointed out above, has a plurality of cylindrical openings 201 formed therein which slidably receive the punch members 202. Each punch member has a top portion 203, a body portion 204, and a bottom portion 205. The top portion is substantially wider than the body portion 204, and the bottom portion 205 is tapered to help it easily pass through the lead alloy. The openings 201 have a stepped portion 206 near the bottom thereof which decreases the cross-sectional dimension of the opening to substantially the size of the body portion 204 of the punch member. With this construction, a ledge 207 is formed within the opening. This ledge 207 forms a seat for a biasing spring 208 which is fitted around the body portion 204 of the punch member underneath the enlarged top portion 203 thereof. In this manner, each biasing spring 208 forces its associated punch member continuously upward against the underneath surface of the top portion 203. Finally, fitted across the tops of the openings are punch stops 209 which act to decrease the size of the openings at the top thereof so that the punch members do not push out the top of the opening due to the upward biasing force of the springs 208. These punch stops 209 may be removable so that the punch members 202 can be removed as they become worn and no longer serviceable.

FIG. 1 shows the various punch members 202 in their raised position, that is, they are not piercing the lead alloy strip on the base plate. In this position, the cam members 500 eccentrically mounted on the punch cam drive shaft 501 are at their shortest distance between the shaft and the punch members. As the eccentric cams rotate on the shaft, the punch members are forced downward against the biasing force of the springs 208 and pierce through the lead-alloy strip 300 (FIG. 2). As the shaft 501 continues to rotate, the distance across the cam to the shaft decreases and the upward force of the biasing spring 208 causes the punch member to move upwardly following the trace of the cam members.

An important structural feature of the punch cam drive shaft 501 and cam arrangement is the provision of counterbalancing weights 502 on the cam shaft which are provided to fully balance the drive shaft during the rotation thereof. As can be seen, seperate clearance notches 210 are provided in the top plate so that the counterbalance members 502 may pass through an appropriate dimensional distance and not interfere with the top plate 200 itself. It is anticipated that each of the punch members 202 in the machine will punch simultaneously through the lead alloy strip 300, and that once withdrawn the entire strip of lead alloy grid material will be indexed forward due to the motion of the eccentric rollers 400, 401 prior to the next punching operation. The counterbalances 502 are weighted not only to balance the weight of the punch cams, but also to counterbalance the weight and momentum of the unison punch movements. In other words, as the eccentric cams force all of the punch members downward, the counterbalancing weights extend in the opposite direction in order to assure that the drive shaft is perfectly balanced. As a result, regardless of the speed at which the machine is run, the entire unit is well balanced and the vibrations which are apparent in the previous types of devices are eliminated.

It has been pointed out that the movement of the lead alloy strip 300 across the base plate 100 is achieved by means of pairs of eccentric rollers 400, 401 which contact and move the lead alloy strip 300 at periodic intervals according to the eccentric configuration of the rollers. Preferably, the rollers are designed to move the lead alloy strip during the period when the punch members 202 are biased upward in the openings 201 (FIG. 1). However, when the punch members begin their downward motion under the influence of the cams 500, the eccentric rollers rotate out of contact with the lead alloy strip 300, thus causing the strip to remain stationary during the punching procedure (FIG. 2). As should be clear from these drawings and the description, the eccentric rollers preferably pull the lead alloy strip across the base plate 100 only through a predetermined arc of rotation thereof. Additionally, these eccentric rollers 400, 401 are mounted on rotatable roller drive shafts 402, 403 respectively. These roller drive shafts, like the punch cam drive shaft 501, also have eccentric counterbalances 404, 405 disposed along the length thereof to balance the movement of these rollers during their rotation. These counterbalances are located at relatively remote end positions on the shafts 402, 403 so that they do not interfere with the lead alloy strip being pierced by the punches. The roller drive shafts 402, 403 are synchronized with the rotation of the punch cam drive shaft 501. In this way, the synchronous motion of punching the lead alloy strip and the subsequent indexing of the strip cord by means of the eccentric rollers is possible as described above.

Although not shown in the attached drawings, the preferred embodiment machine of the present invention will have a desired number, such as 44, of punches diposed in two rows which converge with respect to each other so that the grid material will be expanded to create acceptable automotive battery grids.

When the machine is in operation, it can easily be seen that the rotation of the eccentric roller drive shafts 402, 403 causes the eccentric rollers 400, 401 to rotate through a predetermined arc and engage the lead-alloy strip 300, thus causing it to move forward a predetermined distance corresponding to the eccentricity of the rollers 400, 401. When the strip no longer engages the eccentric rollers, the rotating punch cam drive shaft 500 is at a point of rotation which brings all of the cams 500 into position to force all of the punch members 202 downward against the biasing force of the dye springs 208, thereby causing the punch members to pierce through the lead alloy strip resting on the base plate 100. During the rotation of the shaft 501, the biasing springs 208 continuously force the punch members upward against the trace of the cam members. Therefore, as the cams rotate with the shaft 501, the springs force the punch members upward away from the strip material. And by providing the counterbalances on both the punch cam drive shaft 501 and the roller drive shafts 402, 403, it can be seen that the rotating motion of these shafts containing eccentrically mounted members thereon can be maintained in a completely vibration free condition.

Accordingly, as seen from the above descriptions and drawings, an extremely simple apparatus may be developed wherein a plurality of counterbalanced punch drive shafts may be mounted above rows of biased punch members maintained in a top plate. By synchronizing the movement of the punch cam shaft 501 with the movement of the roller drive shafts 402, 403 rotating the eccentric rollers, all of which are also properly counterbalanced, an extremely smooth running and efficient apparatus for forming automotive grid material is achieved.

It will be understood that various changes in the details, materials and arrangement of parts which have been herein described and illustrated in order to explain the nature of this invention may be made by those skilled in the art within the principle and scope of the invention as expressed in the following claims.

It will further be understood that the "Abstract of the Disclosure" set forth above is intended to provide a non-legal technical statement of the contents of the disclosure in compliance with the Rules of Practice of the U.S. Patent and Trademark Office, and is not intended to limit the scope of the invention described and claimed herein.

What is claimed:

1. A punching apparatus comprising:

a. support means for supporting a material to be punched thereon;

b. biased punch means above said support means, said biased punch means comprised of:

(i) a top plate above said support means said top plate having a plurality of horizontally aligned openings therethrough, (ii) punch means slidably mounted within each said opening and said top plate, and (iii) biasing means engaging said punch means for forcing said punch members upwards within said openings;

c. cam means engaging said punch means for operating said punch means, said cam means comprised of:

(i) a rotary punch cam drive shaft above said aligned openings, and (ii) a plurality of cam members eccentrically mounted on said punch cam drive shaft, one cam member above each opening, and engaging said punch members within said openings;

d. moving means adjacent said support means and said material to be punched for moving material to be punched across said support means synchronously with the motion of said cam means.

2. An apparatus as claimed in claim 1, wherein said cam means is further comprised of:

first counter balancing means connected to said punch cam drive shaft for counter balancing the weight of said cams during rotation of said punch cam drive shaft, whereby vibration of said punch cam drive shaft is substantially eliminated.

3. An apparatus as claimed in claim 2, wherein said top plate is notched to receive counter balancing means.

4. A punching apparatus comprising:

a. support means for supporting material to be punched thereon;

b. biased punch means above said support means for punching through a material to be punched;

c. cam means engaging the said punch means for operating said punch means; and d. moving means adjacent said support means and said material to be punched for moving material to be punched across said support means synchronously with the motion of said cam, said moving means comprised of:

(i) a pair of rotary roller drive shafts, one above and one below said material to be punched;

(ii) roller means eccentrically mounted on each of said roller drive shafts and engagable with said material to be punched for periodically moving said material during rotation of said drive shaft; and (iii) counter balancing means connected to said roller drive shafts for counter balancing said roller means during rotation of said roller drive shafts, whereby vibration of said roller drive shafts is substantially eliminated.

5. An apparatus as claimed in claim 4, wherein said biased punch means is comprised of:

a. a top plate above said support means, said top plate having a plurality of aligned openings therethrough;

b. punch means slidable mounted within said openings and said top plate; and c. biasing means engaging said punch members for forcing said punch members upwardly within said openings.

* * * * *